US009776203B2

(12) United States Patent
Ettlin

(10) Patent No.: US 9,776,203 B2
(45) Date of Patent: Oct. 3, 2017

(54) DISPENSING APPARATUS FOR A MULTI-COMPONENT MASS

(71) Applicant: Sulzer Mixpac AG, Haag (CH)

(72) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 31 days.

(21) Appl. No.: 14/651,721

(22) PCT Filed: Nov. 15, 2013

(86) PCT No.: PCT/EP2013/073925

§ 371 (c)(1),
(2) Date: Jun. 12, 2015

(87) PCT Pub. No.: WO2014/090507

PCT Pub. Date: Jun. 19, 2014

(65) Prior Publication Data

US 2015/0343485 A1 Dec. 3, 2015

(30) Foreign Application Priority Data

Dec. 14, 2012 (EP) ..... 12197298

(51) Int. Cl.
*B01F 5/06* (2006.01)
*B05C 17/005* (2006.01)
(Continued)

(52) U.S. Cl.
CPC ..... *B05C 17/00553* (2013.01); *B01F 5/0082* (2013.01); *B01F 5/0602* (2013.01); *B01F 13/0023* (2013.01); *B01F 15/0087* (2013.01); *B01F 15/0256* (2013.01); *B05C 17/00583* (2013.01); *B65D 81/3261* (2013.01); *B01F 2215/0039* (2013.01)

(58) Field of Classification Search
CPC ..... B05C 17/00553; B05C 17/00583; B65D 81/3261; B01F 5/0602; B01F 5/0082; B01F 13/0023; B01F 15/0087; B01F 15/0256; B01F 2215/0039
See application file for complete search history.

(56) References Cited

U.S. PATENT DOCUMENTS 2,890,868 A * 6/1959 Potchen ..... B01F 5/0604 239/402
3,459,407 A * 8/1969 Hollis ..... B01F 5/0603 138/38

(Continued)

FOREIGN PATENT DOCUMENTS

WO 2006/079413 A2 8/2006
WO 2012/131043 A1 10/2012

*Primary Examiner* — Frederick C Nicolas
(74) *Attorney, Agent, or Firm* — Global IP Counselors, LLP

(57) ABSTRACT

A dispensing apparatus simultaneous discharges at least two flowable components of a multi-component mass from different storage volumes. The dispensing apparatus includes a passive mixing unit having a central mixing passage extending along a flow direction and being configured to guide the components mixed with one another, and including at least two inlets opening into the central mixing passage, the inlets being associated with the same storage volume and open into the mixing passage at different positions along the flow direction.

19 Claims, 2 Drawing Sheets

(51) Int. Cl.

| | |
|---|---|
| ***B01F 5/00*** | (2006.01) |
| ***B01F 13/00*** | (2006.01) |
| ***B01F 15/00*** | (2006.01) |
| ***B65D 81/32*** | (2006.01) |
| ***B01F 15/02*** | (2006.01) |

(56) References Cited

U.S. PATENT DOCUMENTS

| | | | | |
|---|---|---|---|---|
| 3,927,868 | A | 12/1975 | Moore | |
| 7,152,758 | B2 * | 12/2006 | Fazzio | A45D 34/02 222/145.1 |
| 2004/0238052 | A1 | 12/2004 | Karp et al. | |
| 2005/0248049 | A1 | 11/2005 | Gannaway et al. | |
| 2007/0068964 | A1 * | 3/2007 | Tanaami | B01F 5/0641 222/94 |
| 2008/0123465 | A1 | 5/2008 | Heusser et al. | |

* cited by examiner

DISPENSING APPARATUS FOR A MULTI-COMPONENT MASS

CROSS-REFERENCE TO RELATED APPLICATIONS

This application is a U.S. National stage application of International Application No. PCT/EP2013/073925, filed Nov. 15, 2013, which claims priority to EP Patent Application 12197298.8, filed Dec. 14, 2012, the contents of each of which are hereby incorporated herein by reference.

BACKGROUND

Field of the Invention

The invention relates to a dispensing apparatus for the simultaneous discharge of at least two flowable components from a multi-component mass from different storage volumes.

Background Information

From WO 2006/079413 A2 a dispensing apparatus is already known for the simultaneous discharge of two flowable components of a multi-component mass from different storage volumes including a passive mixing unit which has a central mixing passage with an additional mixing element which extends along a flow direction for the guidance of the components mixed with one another and includes at least two inlets which open into the central mixing passage upstream of the additional mixing element.

SUMMARY

The invention is, in particular based on the object to provide a cost-effective and simple dispensing apparatus for a multi-component mass. It is satisfied by a dispensing apparatus in accordance with the invention corresponding to the independent claim. Embodiments of the invention result from the dependent claims.

The invention is based on a dispensing apparatus for the simultaneous discharge of at least two flowable components of a multi-component mass from different storage volumes having a passive mixing unit which has a central mixing passage which extends along a flow direction for the guidance of the components mixed with one another; and includes at least two inlets which open into the central mixing passage.

It is suggested that the inlets open into the mixing passage at different positions along the flow direction. In this way it can thereby achieved that the individual components are mixed with one another in the central passage without an additional mixing element having to be arranged in the mixing passage which is provided for a mixing of the individual components with one another. Through a design in accordance with the invention, thus an additional mixing element can be omitted in the central mixing passage, whereby the dispensing apparatus can be configured particularly cost-effectively. A multi-component mass should, in particular be understood as a flowable mass composed of at least two components, wherein at least one of the components is an activator, by means of which a chemical reaction is started after a mixing of the components, by means of which chemical reaction chemical or physical properties of the multi-component are changed. A "component of the multi-component mass" should in this connection, in particular be understood as a flowable material which can be stored over a long period of time in an unmixed state with a different component which period of time is longer than a period of time in which, following the mixing of the components, the chemical reaction takes place. Preferably, the components separate from one another can be stored over a period of time of weeks, months or even of years, while the multi-component mass takes on its final properties after the mixing of the components within a period of time of seconds, minutes or hours. A "passive mixing unit" should, in particular be understood as a mixing unit which merely has position fixedly arranged components and which brings about a mixing of the components through a movement of the components through the mixing unit for the mixing of the individual components. An "inlet" should in this connection, in particular be understood as a passage opening into the central mixing passage which passage should be provided merely for the guidance of one of the components, this means not for the guidance of the mixed multi-component mass. A "central mixing passage" should in this connection, in particular be understood as a passage which is provided for the guidance of the components mixed with one another. A "flow direction" should, in particular be understood as a direction along which the components flow, in particular, after they have been mixed with one another, when they are discharged from the dispensing apparatus. The flow direction is provided, in particular by a direction of extent of the inlets and/or of the central mixing passage and can generally deviate from a straight line direction, for example, when the central mixing passage is bent over for a better handling or when it is configured wave-shaped. "Provided" should, in particular be understood as specifically designed and/or adapted.

In that the inlets, which open at different positions into the central mixing passage, are associated with the same storage volume it can be achieved, that the respective components can already be admixed at different positions with a multi-component mass already present in the mixing passage, whereby a particularly good mixing of the components can be achieved.

Furthermore, the mixing unit has at least one further inlet which opens into the mixing passage, both components can be combined at one of the positions, whereby the mixing of the components can further be improved without an additional mixing element being required. Or one of the components can be supplied at a further position to the already mixed multi-component mass, whereby likewise the mixing can be improved.

It is further suggested that the mixing unit has at least one inlet passage directly adjoining at the storage volume which branches at least once into at least two inlets. Thereby the dispensing apparatus can be of particularly simple design from a construction point of view. A "inlet passage" should in this connection, in particular be understood as a passage for the guidance of precisely one of the components of the multi-component mass via which inlet passage the components are distributed to the inlets associated with the storage volumes from the corresponding storage volumes. Preferably, the dispensing apparatus has a like number of inlet passages and storage volumes.

In an advantageous embodiment of the invention it is suggested that the at least one inlet passage and the central mixing passage extend at least substantially in parallel. Thereby, the dispensing apparatus can be manufactured by simple form parts, whereby a particularly simple and thus cost-effective mass production is possible.

Preferably, the at least two inlets open from different sides into the central mixing passage. Thereby a particularly good mixing of the components can be achieved. "From different sides" should in this connection, in particular be understood such that the inlets open from different sides into the mixing passage with respect to a plane which lies in the central mixing passage.

Particularly advantageously, the inlets associated with one of the supply volumes respectively alternatively open from the sides into the central mixing passage. Thereby a particularly good through-mixing can be achieved. "Alternatively" in this connection should, in particular be understood such that the inlets, which are associated with the same storage volumes, change sides along the flow direction, from which sides the inlets open into the central mixing passage.

It is further suggested that the dispensing apparatus includes a packaging film which forms a part of the inlets. Through such a design the inlets can be realized in a particularly simple manner. In this connection a "film" should generally, in particular be understood as a metal or plastic sheet having a thickness of at most 1 millimeter. Preferably the thickness of the film is at most 500 microns. Particularly advantageously the film has a thickness of at most 100 microns. A "packaging film" should specifically, in particular be understood as a film which has a shape deviating from a planar extent by means of which it forms the inlets, such as, in particular a plastic film deformed by means of a shape.

If the packaging film further at least partly forms the storage volumes and the at least one inlet passage, then the dispensing apparatus can be designed in a particularly simple manner from a construction point of view. In particular, a design of the dispensing apparatus having a small number of parts is possible, whereby moreover a particularly cost-effective manufacture can be realized.

It is moreover suggested that the packaging film at least partly forms the central mixing passage. Thereby, the design can be further simplified from a construction point of view. Preferably the inlets, the storage volumes, the at least one inlet passage and the mixing passage can be manufactured in a forming step from a film blank.

Preferably, the packaging film at least partly forms the central mixing passage. Thereby, the design of the dispensing apparatus can further be simplified from a construction point of view. Preferably the inlets, the storage volumes, the at least one supply passage and the mixing passage can be manufactured in one forming step from a film blank.

It is further suggested, that the dispensing apparatus has a cover film which at least partly forms a part of the inlets. Thereby a dispensing apparatus in accordance with the invention can be manufactured in a particularly simple manner, in particular when the inlets should open into the mixing passage from different sides.

Advantageously, the dispensing apparatus further includes a sealing film arranged between the packaging film and the cover film. Thereby, in particular the inlets, which are partly formed by the packaging film and partly formed by the cover film, can be separated form one another in a particularly simple manner. Through such a design the dispensing apparatus can be formed as a blister which is formed by the packaging film, the cover film and the sealing film. The packaging film, the cover film and the sealing film can in this connection, be connected to one another in a welding process, whereby a simple and cost-effective design can be realized.

If the sealing film at least bounds the central mixing passage, the at least one inlet passage and at least some of the inlets, a number of the components required for the design of the dispensing apparatus can be kept small. In particular, a three part design is thereby plausible.

In a particularly advantageous embodiment the sealing film has at least one perforation which connects the at least one inlet formed by the cover film to the at least one inlet passage formed by the packaging film. Thereby, the inlets formed by the cover film can be connected to the inlet passage in a simple manner, whereby the inlets can be arranged totally in two different planes which are separated from one another by the sealing film.

Moreover, it is advantageous when the sealing film has at least one perforation which connects the at least one inlet formed by the cover film to the central mixing passage formed by the packaging film. Thereby it can, in particular be realized that the inlets open into the central mixing passage from different sides in a simple manner, whereby a particularly simple design from a construction point of view is possible.

It is moreover suggested that the dispensing apparatus has at least one activation pin which is provided to generate at least one of the perforations on an activation. Thereby, the components can be separated from one another by the sealing film in a state of delivery, whereby a premature mixing can be avoided to a high degree of safety. At the same time, the dispensing apparatus can be activated particularly simply, for example, in that the mixing unit is compressed, whereby a simple handling of the dispensing apparatus can be achieved.

Further advantages result from the following description of the Figures. In the Figures an embodiment of the invention is illustrated. The Figures, the description of the Figures and the claims include numerous features in combination. The person of ordinary skill in the art will expediently also consider these features individually and combine these to suitable further combinations.

BRIEF DESCRIPTION OF THE DRAWINGS

There is shown.

DETAILED DESCRIPTION OF EMBODIMENTS

Figure 1:
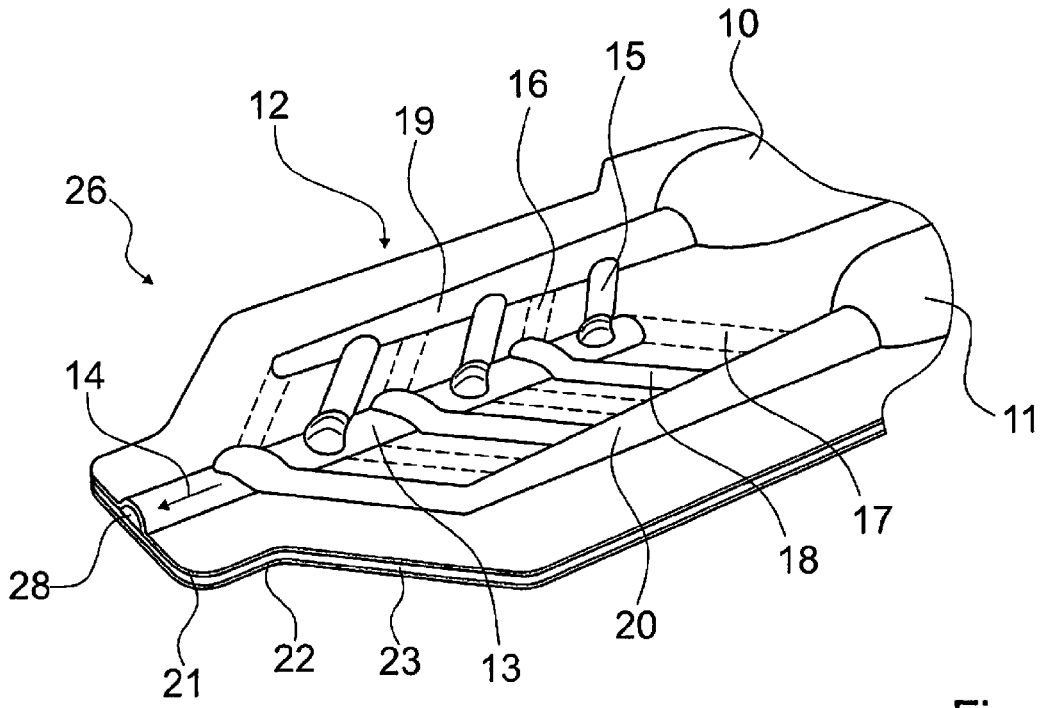
FIG. 1 is a mixing unit of a dispensing apparatus in accordance with the invention.
Figure 2:
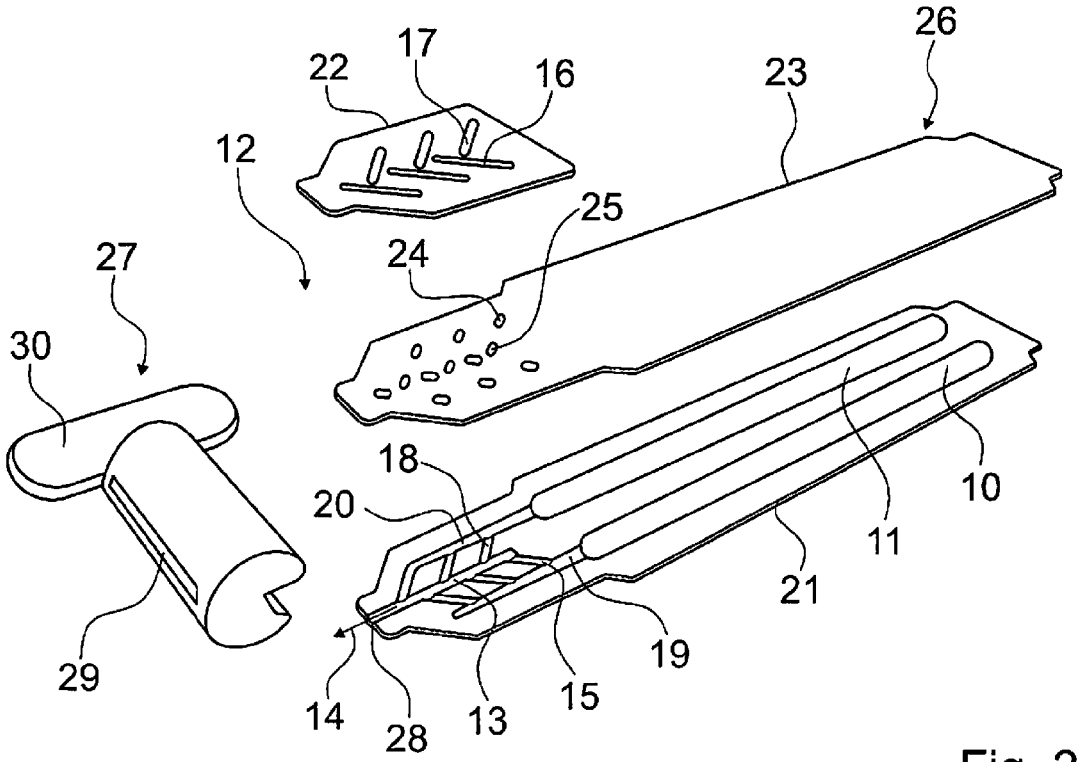
FIG. 2 is an illustration of individual components of the dispensing apparatus.
Figure 3:
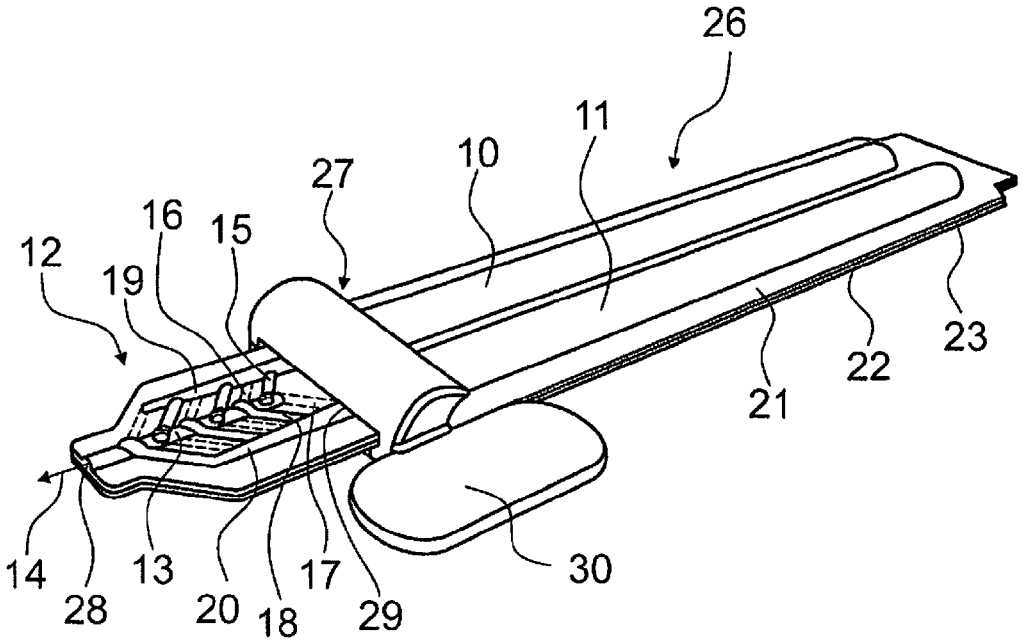
FIG. 3 is an overall view of the dispensing apparatus prior to its use.

FIGS. 1 to 3 show a dispensing apparatus for the simultaneous discharge of two components of a multi-component mass from different storage volumes 10, 11. The dispensing apparatus forms a so-called blister 26 which encloses the components for a storage of the multi-component mass and is simultaneously provided for the discharge of the multi-component mass in the mixed state. Moreover, the dispensing apparatus in the illustrated embodiments includes a clip 27 configured separate from the blister 26 which is provided for the closure of the blister 26 during the storage (cf. FIG. 3) and which is provided as a dispensing aid for expelling the components.

The dispensing apparatus in the illustrated embodiment includes two storage chambers which bound the storage volumes 10, 11. The storage volumes 10, 11 are arranged next to one another. Through a compression of the storage chambers, for example, in that the blister 26 is rolled up by means of the clip 27, the individual components are expelled from the storage volumes 10, 11. In order to mix the components with one another, the dispensing apparatus has a passive mixing unit 12, in which the components are mixed with one another solely by their movement through the mixing unit 12 to the ready for use multi-component mass.

The mixing unit 12 includes a central mixing passage 13 which is provided for the guidance of the components mixed with one another along a flow direction 14. The central mixing passage 13 ends at an applicator opening 28 via which the multi-component mass exits on a discharge from the blister 26. The mixing passage 13 has a substantially semicircular cross-section. This is free of mixing elements which are arranged for a mixing of the components in the mixing passage 13.

For connecting the storage volumes 10, 11 to the mixing passage 13 the dispensing apparatus includes a plurality of inlets 15, 16, 17, 18 which open into the central mixing passage 13. For reasons of clarity only a part of the inlets 15, 16, 17, 18 is provided with reference numerals. Each of the inlets 15, 16, 17, 18 is associated with precisely one of the storage volumes 10, 11. During the discharge of a multi-component mass the component, which is arranged in the corresponding storage volumes 10, 11, flows through the inlets 15, 16, 17, 18 associated with the storage volumes 10, 11.

The inlets 15, 16, 17, 18 open along the flow direction 14 at different positions into the central mixing passage 13. The mixing unit 12 includes storage volumes 10, 11 each having at least two inlets 15, 16, 17, 18, which open at different positions into the different passage 13 along the flow direction 14. In the illustrated embodiment the mixing unit 12 includes storage volumes 10, 11 each having six inlets 15, 16, 17, 18 which are configured separate from one another and which open at different positions into the central mixing passage 13. The mixing unit 12 in this connection has an equal number of inlets 15, 16, 17, 18 per storage volume 10, 11. In dependence on the used multi-component mass also more or less than the number of illustrated inlets 15, 16, 17, 18 can be used (cf. FIG. 1) per storage volume 10, 11.

For connecting the inlets 15, 16, 17, 18 to the respectively associated storage volume 10, 11, the mixing unit 12 includes two inlet passages 19, 20 which are directly connected respectively to one of the storage volumes 10, 11. The inlet passages 19, 20 and the central mixing passage 13 extend in parallel with respect to one another. Spatially the central mixing passage 13 is arranged between the two inlet passages 19, 20. Each of the inlets 15, 16, 17, 18 connects the central mixing passage 13 to one of the inlet passages 19, 20.

Two of the inlets 15, 16, 17, 18 respectively open at one position into the central mixing passage 13. The positions in this way respectively form an intersection at which the corresponding two inlets 15, 16, 17, 18 and the central mixing passage 13 are connected to one another from a flow point of view. The central mixing passage 13 and the inlet passages 19, 20 are arranged in a common plane. The inlets 15, 16, 17, 18 respectively associated pairwise at a position open into the central mixing passage 13 from different sides with respect to the central mixing passage 13.

Two of the inlets 15, 16, 17, 18 respectively open into the central mixing passage 13 perpendicular to the plane in which the central mixing passage 13 and the inlet passages 19, 20 are arranged at one position. The one inlet 15, 18 in this connection opens from above into the central mixing passage 13. The further one inlet 16, 17 opens from below into the central mixing passage 13. In this connection the storage volume 10, 11 changes the inlet 15, 16, 17, 18, opening at each position into the mixing passage 13 from the corresponding side, along the flow direction 14. The inlets 15, 16 associated with one of the storage volumes 10 respectively open into the central mixing passage 13 from above and from below in an alternating manner. In analogy, the inlets 17, 18 associated with the other storage volume 11 likewise open into the central mixing passage 13 from above and from below in an alternating manner. The inlets 15, 16, 17, 18 respectively associated with one of the storage volumes 10, 11 always open from the same side into the central mixing passage 13 in parallel to the plane, in which the central mixing passage 13 and the inlet passages 19, 20 are arranged.

In order to connect the inlets 15, 16, 17, 18 from the different sides to the central mixing passage 13, the blister 26, which stores the individual components, is configured of three parts. For forming the blister 26 the dispensing apparatus includes a packaging film 21, a cover film 22, and a sealing film 23. All have a thickness which lies in the region of a few tenths of a millimeter. The sealing film 23 is formed substantially planar. The packaging film 21 and the cover film 22 are configured as formed parts.

The sealing film 23 extends in parallel to the plane, in which the central mixing passage 13 and the inlet passages 19, 20 are arranged. The sealing film 23 defines the plane with respect to which the inlets 15, 16, 17, 18 open into the central mixing passage 13 from above and from below.

The packaging film 21 forms the storage volumes 10, 11 and the inlet passages 19, 20 adjoining at the storage volumes 10, 11. Moreover, the packaging film 21 forms the central mixing passage 13 and some of the inlets 15, 16, 17, 18. The cover film 22 forms some of the further inlets 15, 16, 17, 18. The packaging film 21 in this connection forms the inlets 15, 18 opening into the central mixing passage 13 from above, in contrast to which the cover film 22 forms the inlets 16, 17 opening into the central mixing passage 13 from below. The packaging film 21 and the cover film 22 thus respectively form some of the inlets 15, 16, 17, 18.

The sealing film 23 is arranged between the packaging film 21 and the cover film 22. The sealing film 23 is fixedly connected to the packaging film 21 and the cover film 22. For forming the storage volumes 10, 11, the inlet passages 19, 20, the inlets 15, 16, 17, 18 and the mixing passage 13, the packaging film 21 and the cover film 22 respectively have a height sectioning which is formed by deforming a blank by means of a corresponding shape. With respect to the plane in which the sealing film 23 is arranged the height sectioning of the packaging film 21 and the height sectioning of the cover film 22 form depressions. If the sealing film 23 is connected to the packaging film 21 and the cover film 22, then these depressions form hollow spaces which form the storage volumes 10, 11, the inlet passages 19, 20, the inlets 15, 16, 17, 18 and the mixing passage 13. The sealing film 23 thus bounds the storage volumes 10, 11, the inlet passages 19, 20, the inlets 15, 16, 17, 18 and the mixing passage 13 which is formed by the packaging film 21 and the cover film 22. In this connection, merely the central mixing passage 13 is open in the shape of one of the end faces of the blisters 26 of the applicator 28 in the direction of its environment.

For connecting the inlets 16, 17 formed by the cover film 22 to the corresponding inlet passage 19, 20 and to the central mixing passage 13 the sealing film 23 has a plurality of perforations 24, 25 of which merely some are provided with reference numerals for reasons of clarity. Two of the perforations 24, 25 are associated with each of the inlets 16, 17. The respective outer perforation 24 connects the associated inlet passage 20 to the corresponding inlet 17. The respective inner perforation 25 connects the corresponding inlet 17 to the mixing passage 13. The respective inner perforation 25 are arranged at positions which are equal to the positions at which the inlets 15, 18 configured by the packaging film 21 terminate.

The clip 27 is configured as a part separate from the blister 26. The clip 27 is provided for the closing of the blister 26 during a storage and for expelling the multi-component mass from the storage volumes 10, 11. The clip 27 of one piece design has a substantially cylindrical basic shape having a slot-like recess 29 through which the blister 26 can be guided with its ends. The clip 27 moreover includes two wings 30 which are provided for a user for the rolling up of the blister 26. For closing the clip 27 is pushed over the mixing unit 12, whereby, in particular the inlet passages 19, 20 are closed. For activating the dispensing apparatus, the clip 27 is removed from the mixing unit 12 and the opposing end is placed onto the blister 26. Through rolling up the blister 26 at the clip 27 the components stored in the storage volumes are expelled and arrive in the central mixing passage 13 via the inlet passages 19, 20 and the inlets 15, 16, 17, 18. There the components are mixed with one another and are subsequently discharged via the central mixing passage 13.

Figure 4:
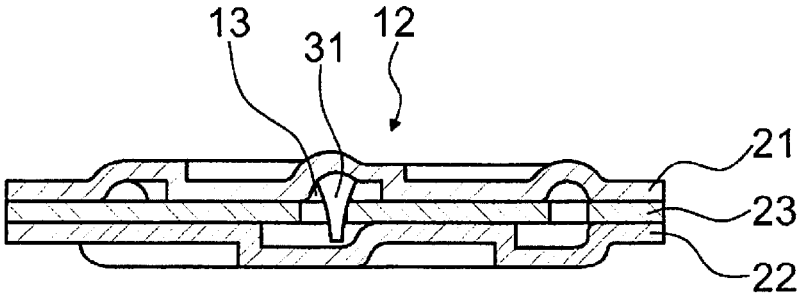
FIG. 4 is a cross-section through the dispensing apparatus.

In order to separate the individual components from one another during storage, the dispensing apparatus includes a plurality of activation pins 31 (cf. FIG. 4). The activation pins 31, of which merely one is illustrated, are provided to generate the perforations 25 in the sealing film 23 on an activation of the dispensing apparatus. The activation pins 31 are fixedly connected to the packaging film 21. If the clip 27 is removed from the mixing unit 12 the activation pins 31 penetrate through the sealing film 23, whereby the inlet passages 19, 20 are connected to the central mixing passage 13 via the perforations 24, 25. The activation pins 31 in this connection are provided to generate the inner perforations 25. The dispensing apparatus is thus provided to be activated by a removal of the clip 37 from the mixing unit 12. The perforations can also be directly present and do not have to be initially generated by means of the activation pins.

In an alternative embodiment, not illustrated in detail, the inlet passages can be configured at least partly by the respective storage volume to which they are connected. In such an embodiment the central mixing passage is arranged between the two storage volumes. The inlets opening into the central mixing passage from different sides and at different positions in such a design can directly connect the storage volumes and the central mixing passage to one another. In that the inlet passages are formed by the storage volumes a design of the inlet passages by means of the packaging film from a construction point of view can be omitted. The outer perforations are installed in the sealing film in a region of the storage volume for such a design and connect the inlets opening into the central mixing passage from below to the storage volumes. The inlets which open into the central mixing passage from above directly adjoin at the storage volumes and branch off laterally from the storage volumes.

The invention claimed is:

1. A dispensing apparatus, for the simultaneous discharge of at least two flowable components of a multi-component mass from different storage volumes, the dispensing apparatus comprising:

a passive mixing unit having a central mixing passage extending along a flow direction and being configured to guide the components mixed with one another, including at least two inlets opening into the mixing passage, the inlets being associated with the same storage volume and open into the mixing passage at different positions along the flow direction, and having at least one further inlet opening into the mixing passage.

2. The dispensing apparatus in accordance with claim 1, further comprising a packaging film forming a part of the inlets.

3. The dispensing apparatus in accordance with claim 2, wherein the mixing unit has at least one inlet passage adjoining directly at one of the storage volumes, the inlet passage branching at least once into the at least two inlets and the packaging film at least partly forming the storage volumes and the at least one inlet passage.

4. The dispensing apparatus in accordance with claim 2, wherein the packaging film at least partly forms the central mixing passage.

5. The dispensing apparatus in accordance with claim 1, further comprising a cover film at least partly forming a part of the inlets.

6. The dispensing apparatus in accordance with claim 5, further comprising a packaging film forming a part of the inlets and a sealing film arranged between the packaging film and the cover film.

7. The dispensing apparatus in accordance with claim 6, wherein the mixing unit has at least one inlet passage adjoining directly at one of the storage volumes, the inlet passage branching at least once into the at least two inlets and the sealing film bounding at least the central mixing passage, the at least one inlet passage and at least one of the in lets.

8. The dispensing apparatus in accordance with claim 7, further comprising a packaging film forming part of the inlets, the mixing unit having at least one inlet passage adjoining directly at one of the storage volumes, the inlet passage branching at least once into at least two of the inlets and the packaging film at least partly forming the storage volumes and the at least one inlet passage and the sealing film having at least one perforation connecting the at least one inlet formed by the cover film to the inlet passage formed by the packaging film.

9. The dispensing apparatus in accordance with claim 7, further comprising a packaging film forming part of the inlets, the mixing unit having at least one inlet passage adjoining directly at one of the storage volumes, the inlet passage branching at least once into at least two of the inlets and the packaging film at least partly forming the storage volumes and the at least one inlet passage and the sealing film having at least one perforation connecting the at least one inlet formed by the cover film to the central mixing passage formed by the packaging film.

10. The dispensing apparatus in accordance with claim 8, further comprising at least one activation pin disposed so as to generate an activation of at least one of the perforations.

11. The dispensing apparatus in accordance with claim 9, further comprising at least one activation pin disposed so as to generate an activation of at least one of the perforations.

12. A dispensing apparatus, for the simultaneous discharge of at least two flowable components of a multi-component mass from different storage volumes, the dispensing apparatus comprising:

a passive mixing unit having a central mixing passage extending along a flow direction and being configured to guide the components mixed with one another, and including at least two inlets opening into the central mixing passage, the inlets being associated with the same storage volume and open into the mixing passage at different positions along the flow direction, and at least one inlet passage adjoining directly at one of the storage volumes, the inlet passage branching at least once into the at least two inlets.

13. The dispensing apparatus in accordance with claim 12, wherein the at least one inlet passage and the central mixing passage extend at least substantially in parallel.

14. The dispensing apparatus in accordance with claim 12, further comprising a packaging film forming a part of the inlets.

15. The dispensing apparatus in accordance with claim 12, further comprising a cover film at least partly forming a part of the inlets.

16. A dispensing apparatus, for the simultaneous discharge of at least two flowable components of a multi-component mass from different storage volumes, the dispensing apparatus comprising:

a passive mixing unit having a central mixing passage extending along a flow direction and being configured to guide the components mixed with one another, and including at least two inlets opening from different sides into the central mixing passage, the inlets being associated with the same storage volume and opening into the mixing passage at different positions along the flow direction.

17. The dispensing apparatus in accordance with claim 16, wherein the inlets associated with the same storage volume alternatively open from the sides into the central mixing passage.

18. The dispensing apparatus in accordance with claim 16, further comprising a packaging film forming a part of the inlets.

19. The dispensing apparatus in accordance with claim 16, further comprising a cover film at least partly forming a part of the inlets.

* * * * *